US007581510B2

(12) United States Patent
Wu

(10) Patent No.: US 7,581,510 B2
(45) Date of Patent: Sep. 1, 2009

(54) DISPLAY DEVICE FOR GOLF CLUB PROTECTOR

(76) Inventor: Chiawen Wu, 7800 Penny Lane, Richmond, BC (CA) V6Y 2Z1

( * ) Notice: Subject to any disclaimer, the term of this patent is extended or adjusted under 35 U.S.C. 154(b) by 0 days.

(21) Appl. No.: 11/837,669

(22) Filed: Aug. 13, 2007

(65) Prior Publication Data

US 2008/0223284 A1 Sep. 18, 2008

(30) Foreign Application Priority Data

Mar. 13, 2007 (CN) ..... 2007 2 0118907 U

(51) Int. Cl.
*G09F 11/02* (2006.01)
*A63B 57/00* (2006.01)

(52) U.S. Cl. ..... 116/311; 116/299; 116/314; 150/160; 40/493; 40/915

(58) Field of Classification Search ..... 116/311–315, 116/305–307, 309, 279, 284, 285, 294, 299, 116/222, 223; 40/322, 331, 334, 335, 5, 40/446, 493, 501, 508, 509, 606.02, 915, 40/594, 730, 795, 607.13; 150/160; 206/315.2–315.4; 473/282, 287, 407; 235/1 B, 123, 59, 62, 235/68, 114, 117 A, 118
See application file for complete search history.

(56) References Cited

U.S. PATENT DOCUMENTS 865,200 A * 9/1907 Moore et al. ..... 235/79
1,738,909 A * 12/1929 Kurz ..... 74/160
2,838,238 A * 6/1958 Menes ..... 235/113
3,000,559 A * 9/1961 Dom ..... 235/113
3,133,577 A * 5/1964 Bellevue, Sr. ..... 150/160
3,169,331 A * 2/1965 Herster ..... 40/504
3,270,959 A * 9/1966 Young et al. ..... 235/110
3,312,395 A * 4/1967 Nara ..... 235/114
3,556,398 A * 1/1971 Walsh et al. ..... 235/110
3,574,963 A * 4/1971 Rosenow ..... 40/5
4,037,719 A * 7/1977 Perlmutter ..... 206/266
4,247,111 A * 1/1981 Weindel ..... 273/148 R
4,520,855 A * 6/1985 Dien ..... 150/160
4,991,338 A * 2/1991 Jones ..... 40/653
5,574,268 A * 11/1996 Herman et al. ..... 235/91 R (Continued)

*Primary Examiner*—Amy Cohen Johnson
(74) *Attorney, Agent, or Firm*—Garcia-Zamor IP Law; Ruy M. Garcia-Zamor

(57) ABSTRACT

The invention teaches a press-button type display indicator for golf club protector, comprising an enclosure having a marker display window and a connective device to engage with the golf club protector; a rotation wheel that can be rotated intermittently and a first half shaft and a second half shaft serving to supply the rotation of the rotation wheel set inside of the enclosure, wherein the first half shaft and the second half shaft are hollow tube shafts, and are located at the two sides of the rotation wheel, respectively; a pressing apparatus connected to the rotation wheel is disposed at one side of the rotation wheel; and a plurality of different markers is distributed along the circumferential direction of the rotation wheel, and is displayed orderly through the marker display window on the enclosure when rotating the rotation wheel intermittently. Since the display indicator of the invention for golf club protector is marked with a plurality of different numbers and symbols, the display marker can be changed easily according to demand, the function of displaying various numbers of commonly used golf clubs with one display indicator is realized, and the inconvenience of carrying a plurality of marker tags simultaneously is avoided.

12 Claims, 5 Drawing Sheets

U.S. PATENT DOCUMENTS 5,730,658 A * 3/1998 Kurtz et al. ..... 473/205
6,336,453 B1 * 1/2002 Scarrott et al. ..... 128/200.23
2008/0108455 A1 * 5/2008 Wu ..... 473/407
2008/0222931 A1 * 9/2008 Wu ..... 40/493
2008/0222933 A1 * 9/2008 Wu ..... 40/642.02
2008/0223284 A1 * 9/2008 Wu ..... 116/315

* cited by examiner

DISPLAY DEVICE FOR GOLF CLUB PROTECTOR

CROSS-REFERENCE TO RELATED APPLICATIONS

This application claims priority to Chinese Patent Application No. 200720118907.3 filed on Mar. 13, 2007, the contents of which are incorporated herein by reference.

BACKGROUND OF THE INVENTION

1. Field of the Invention

This invention relates to a press-button type display indicator for golf club protector, and more particularly, to a press-button type display indicator capable of changing the display marker according to demand.

2. Description of the Related Art

It is well known to those skilled in the art that a protector is generally used for protecting a golf club. When not in use, a golf club should be protected well as it is put into a protector, this especially being true for a costly wood, e.g., #1, #2, and #5 woods, and for a costly putter.

A conventional golf club protector comprises a head portion to protect the head of a golf club and a body portion to protect the shaft of a golf club. Generally, the head portion is knitted from a good flannel material, while the body portion is fabricated from an elastic material and is in a shape of an elongated cylinder.

When a golf club is secured in a protector, the head of the club is covered completely and the identifying number of the club is not visible making club selection difficult during play. Therefore, some protectors are permanently marked with markers on their outside. However, in this way, one protector can only be used for a specific club, and cannot be used for other clubs, which can be inconvenient.

Alternatively, some protectors are marked by a detachable marker tag. Although in this way, one protector can be used for different types of clubs by replacing one marker tag with another, it is also inconvenient to carry many sets of marker tags.

SUMMARY OF THE INVENTION

In view of the above-described problems, it is an objective of the invention to provide a display indicator for a golf club protector having more than one different indicia (numbers or symbols) by which the display marker can be changed easily according to demand.

To achieve the above objective, provided is a press-button type display indicator for golf club protector, comprising an enclosure having a marker display window and a connective device serving to engage with the golf club protector. A rotation wheel capable of rotating intermittently and a first half shaft and a second half shaft serving to supply the rotation of the rotation wheel are located inside of the enclosure. Both the first half shaft and the second half shaft are hollow tube shafts located at the two sides of the rotation wheel, respectively. A pressing apparatus connected to the rotation wheel is disposed at one side of the first half shaft. A plurality of different markers is distributed along the circumferential direction of the rotation wheel. When rotating the rotation wheel intermittently, the markers marked thereon can be displayed orderly through the marker display window of the enclosure.

In certain embodiments of the invention, the pressing apparatus comprises a key, a driving wheel, and a key reposition apparatus. The key protrudes from the first half shaft and the outer end of the key is exposed out of the enclosure. A limiting block to limit the rotation of the key is disposed on the inner circumference of the first half shaft. The driving wheel is linked with the rotation wheel circumferentially. A driving ratchet and a driving socket are formed on the key and the driving wheel, respectively, and are geared with each other to drive the driving wheel and the rotation wheel rotating intermittently. The key reposition apparatus is located inside of the second half shaft. A key member is formed on the peripheral edge of the driving wheel, and is engaged with the key slot located in the enclosure to realize the linkage of the driving wheel with the rotation wheel.

In certain embodiments of the invention, the key reposition apparatus comprises a compressing spring and a slide-assisting member located at the end of the compressing spring near the driving wheel. The other end of the compressing spring is supported by the inner surface of the enclosure. The slide-assisting member forms slide fit with the driving wheel.

In certain embodiments of the invention, a key member is formed on the peripheral edge of the first half shaft and the second half shaft, respectively. The key members are engaged with the key slots in the enclosure to fix the first half shaft and the second half shaft circumferentially.

In certain embodiments of the invention, the enclosure comprises a front cover and a back covering having a marker display window. The front cover and the back cover are connected together through the engagement of a tenon with a tenon groove, and are then connected to each other by means of adhesives.

In certain embodiments of the invention, the connective device on the enclosure is a long hole for passing through a cloth strip to engage with the golf club protector.

As a result, since the display indicator of the invention for golf club protector is marked with a plurality of different numbers and symbols, the display marker can be changed easily according to demand, the function of displaying various numbers of commonly used golf clubs with one display indicator is realized, and the inconvenience of carrying a plurality of marker tags simultaneously is avoided.

DETAILED DESCRIPTION OF THE INVENTION

Figure 1:
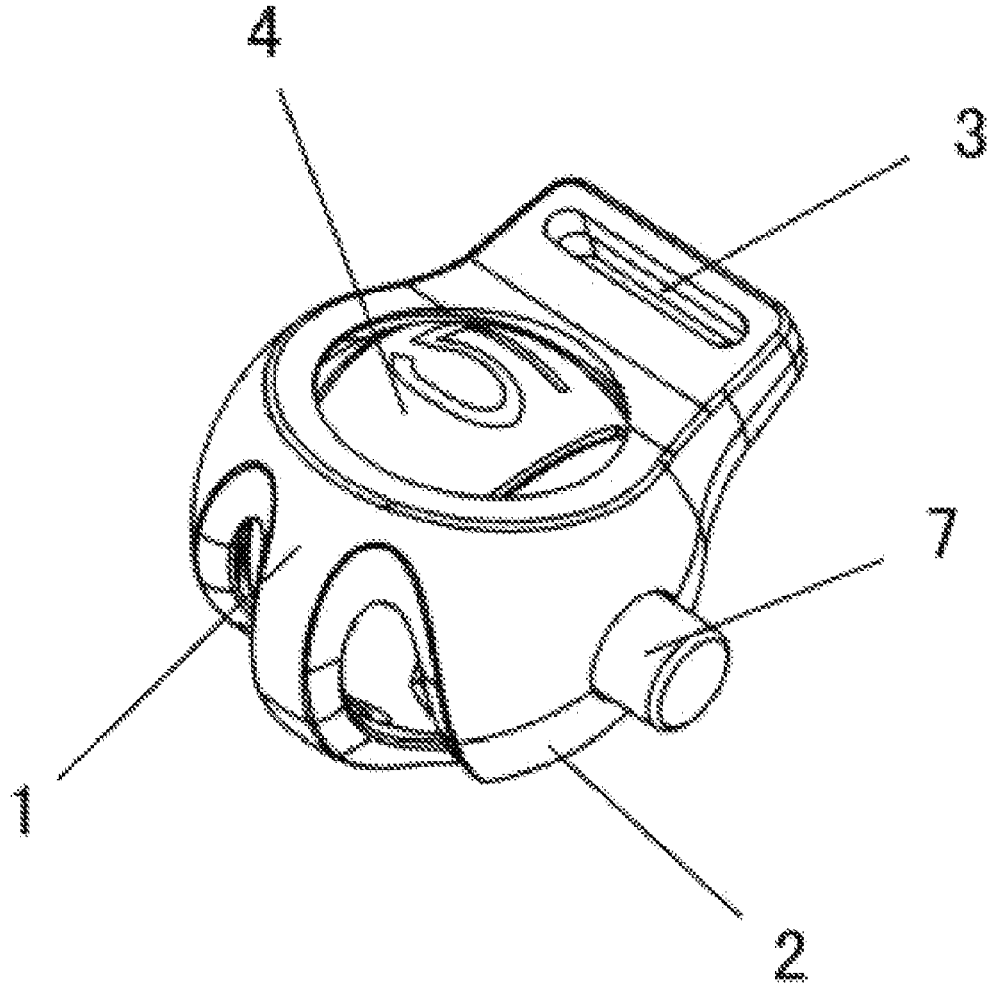
FIG. 1 illustrates a perspective view of the display indicator according to one embodiment of the invention.
Figure 2:
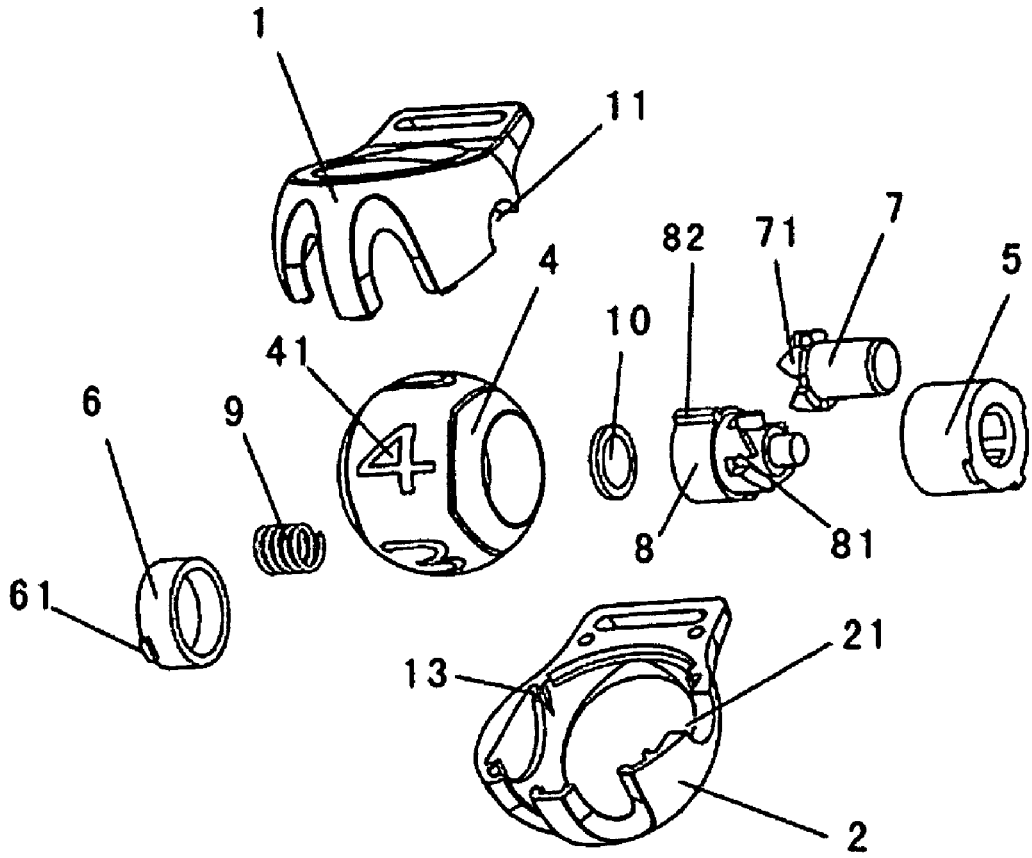
FIG. 2 illustrates an exploded view of the display indicator according to one embodiment of the invention.
Figure 3:
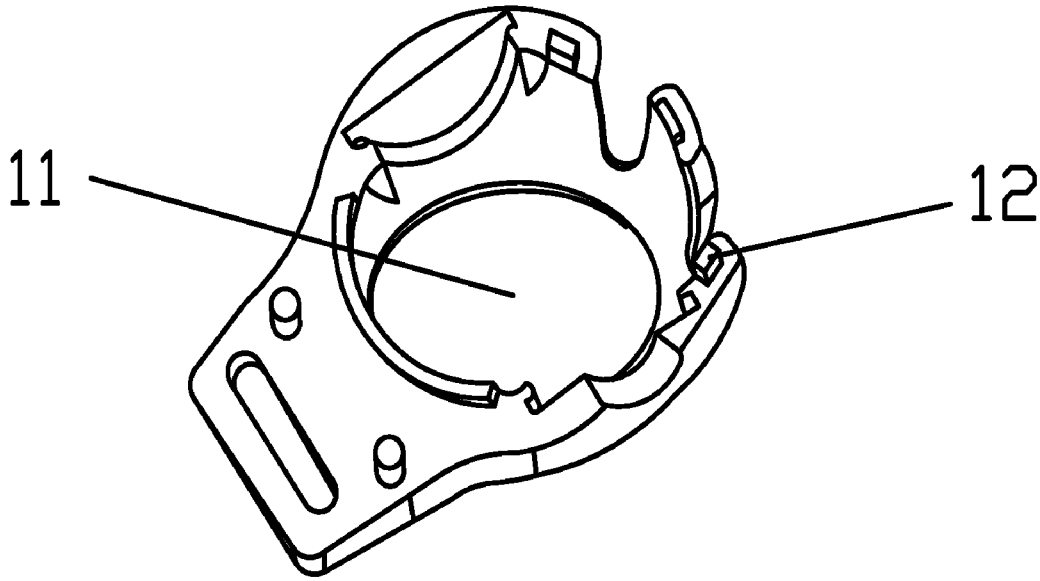
FIG. 3 is a structural view of the inner side of the front cover according to one embodiment of the invention.
Figure 4:
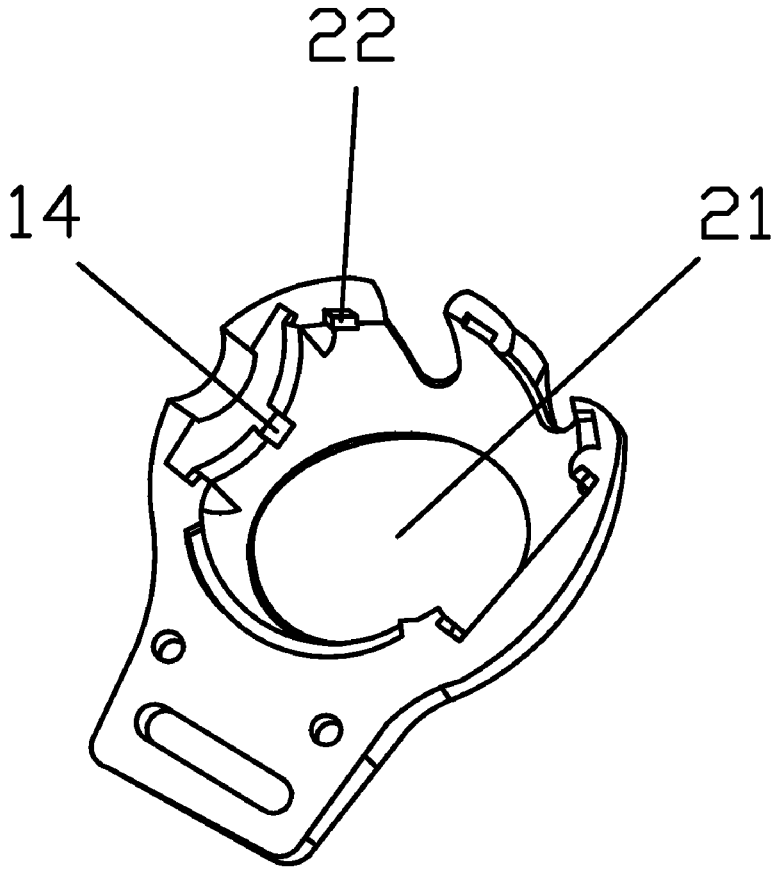
FIG. 4 is a structural view of the inner side of the back cover according to one embodiment of the invention.
Figure 5:
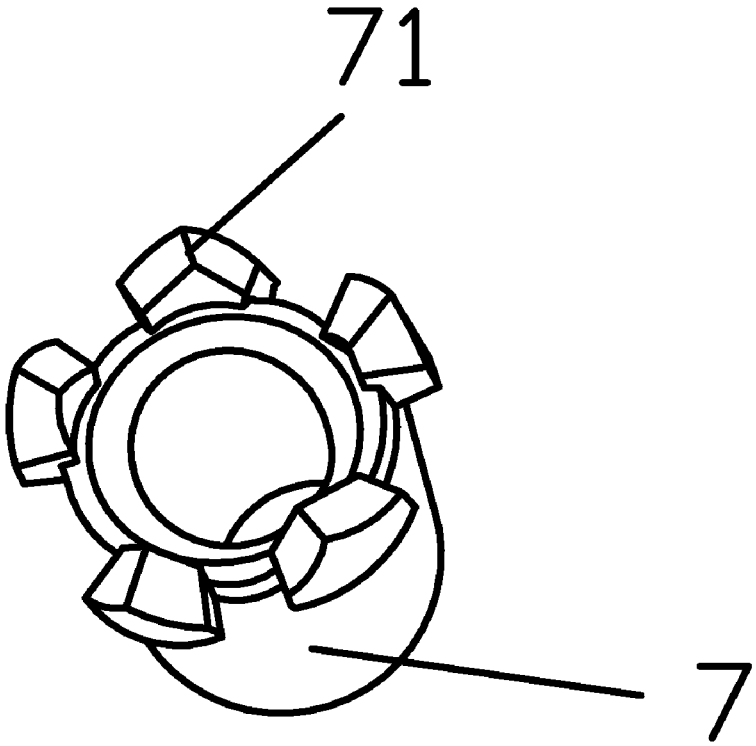
FIG. 5 is a structural view of the key according to one embodiment of the invention.
Figure 6:
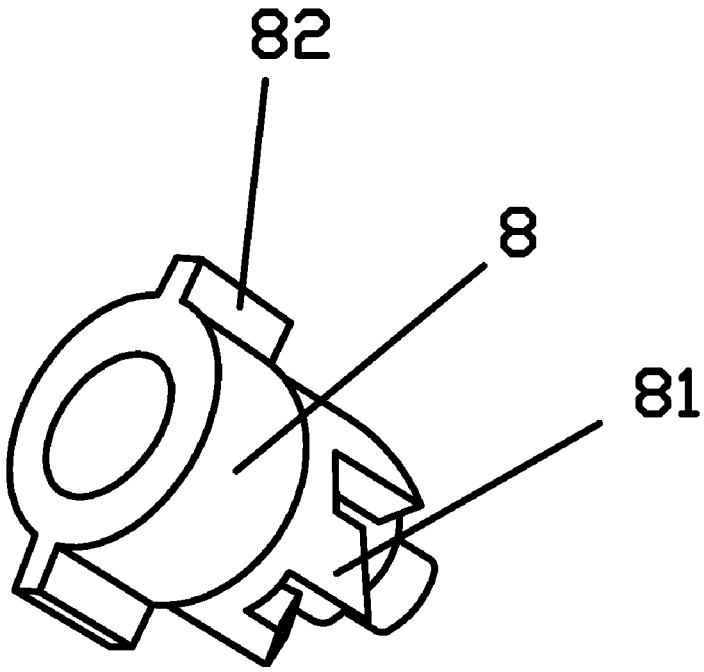
FIG. 6 is a structural view of the driving wheel according to one embodiment of the invention.
Figure 7:
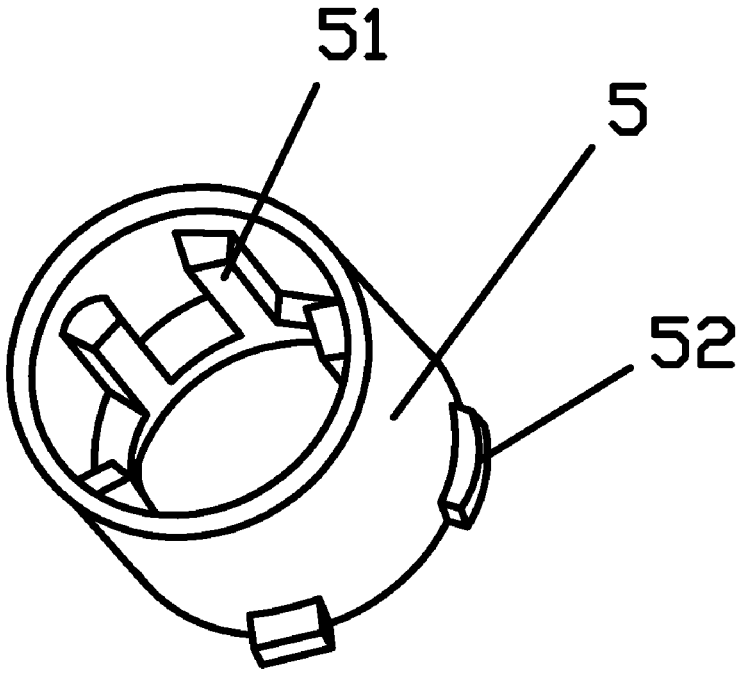
FIG. 7 is a structural view of the first half shaft according to one embodiment of the invention.
Figure 8:
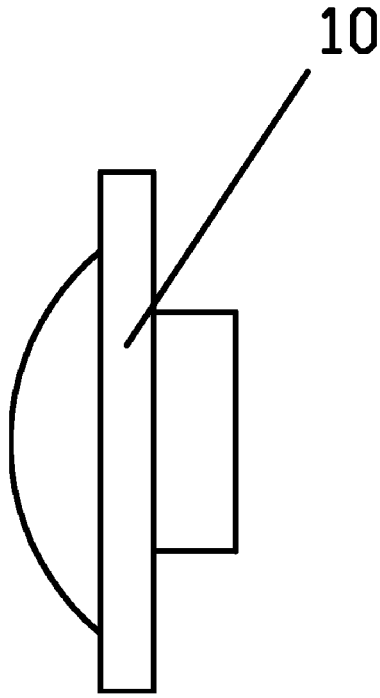
FIG. 8 is a structural view of the slide-assisting member according to one embodiment of the invention.

FIGS. 1-8 illustrate a press-button type display indicator for golf club protector in accordance with one embodiment of the invention, comprising an enclosure having a front cover 1 and a back cover 2. The front cover 1 and the back cover 2 are matched with each other, and have a marker display window 11, 21. The front cover 1 and the back cover 2 are connected by the engagement of a tenon 12 on the front cover 1 with a tenon groove 22 on the back cover 2, and are then undetachably-connected by means of adhesives. A connective device that can be engaged with the golf club protector is formed on the top of the enclosure. Preferably, said connective device is a long hole 3 for passing through a cloth strip to engage with the golf club protector.

In the present embodiment, a rotation wheel 4 capable of rotating intermittently and a first half shaft 5 and a second half shaft 6 serving to permit the rotation of the rotation wheel 4 are located inside of the enclosure. A plurality of different markers 41 is distributed on the circumferential direction of the rotation wheel 4. When rotating the rotation wheel 4 intermittently, the various markers 41 can be displayed orderly through the marker display window of the enclosure. Both the first half shaft 5 and the second half shaft 6 are hollow tube shafts, located at the right side and the left side of the rotation wheel 4, respectively.

A pressing apparatus connected with the rotation wheel 4 is disposed at one side of the first half shaft 5, and comprises a key 7, a driving wheel 8, a compressing spring 9 located inside of the second half shaft 6, and a slide-assisting member 10 located at the end of the compressing spring near the driving wheel 8. The other end of the compressing spring 9 is supported by the inner surface of the enclosure. The slide-assisting member 10 forms slide fit with the driving wheel 4. The key 7 protrudes from the first half shaft 5, and its outer end is exposed out of the enclosure through a key hole 11 located at the right side of the enclosure. A limiting block 51 to limit the rotation of the key 7 is disposed on the inner circumference of the first half shaft 5. The driving wheel 8 is linked with the rotation wheel 4, a driving ratchet 71 and a driving slot 81 are formed on the key 7 and the driving wheel 8, respectively. The driving ratchet 71 is geared with the driving slot 81 to drive the driving wheel 8 and the rotation wheel 4 rotating intermittently. A key member 82 is formed on the peripheral edge of said driving wheel 8, and is engaged with the key slot in the rotation wheel 4 to realize the linkage of the driving wheel 8 with the rotation wheel 4. Two key members 52 and 61 are formed on the peripheral edges of said first half shaft 5 and the second half shaft 6, respectively, and are engaged with the key slots 14 and 13, respectively, to fix the first half shaft and the second half shaft circumferentially.

Under normal conditions, the outer end of the key 7 protrudes out of the key hole 11. When pressing the key 7, the driving ratchet 71 therein engages with the driving slot 81 of the driving wheel 8 and rotates relative to the driving wheel 8. The key does not rotate under the function of the limiting block 51. The driving wheel 8 links with the rotation wheel 4 by the engagement of the key member 82 with the key slot located inside of the rotation wheel 4. Namely, the driving wheel 8 does not rotate relative to the rotation wheel in circumferential direction. Therefore, when pressing the key 7 downward, the driving wheel 8 and the rotation wheel 4 is rotated a certain angle, when releasing the key 7, it bounces under the function of the compressing spring 9, and the driving wheel 8 and the rotation wheel 4 rotates another certain angle to display exactly the next marker through the marker display window so as to complete the change of the display marker. By repeating the above process, the rotation wheel can be rotated around a certain angle to display a specific marker.

While particular embodiment of the invention has been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A press-button type display indicator for golf club protectors comprising:

an enclosure having a marker display window and a connective device to engage with the golf club protector;

a rotation wheel that can be rotated intermittently;

a first half shaft and a second half shaft serving to supply the rotation of the rotation wheel disposed inside of the enclosure; wherein the first half shaft and the second half shaft are hollow tube shafts, and are located at two opposite sides of the rotation wheel;

a pressing apparatus connected to the rotation wheel disposed at one side of the rotation wheel; and a plurality of markers distributed along the circumferential direction of the rotation wheel, and are displayed through the marker display window on the enclosure when rotating the rotation wheel intermittently;

wherein said pressing apparatus comprises a key, a driving wheel, and a key reposition apparatus;

the key protrudes from the first half shaft;

the outer end of the key is exposed out of the enclosure;

a limiting block to limit the rotation of the key is disposed on the inner circumference of the first half shaft;

the driving wheel is linked with the rotation wheel circumferentially;

a driving ratchet and a driving socket are formed on the key and the driving wheel respectively, and are geared with each other to drive the driving wheel and the rotation wheel rotating intermittently; and the key reposition apparatus is located inside of the second half shaft.

2. The indicator of claim 1, wherein a key member is formed on the peripheral edge of said driving wheel, and is engaged with a key slot located in the enclosure to realize the linkage of the driving wheel with the rotation wheel.

3. The indicator of claim 2, wherein said enclosure comprises a front cover and a back cover, and the front cover and the back cover are connected together through engagement of a tenon with a tenon groove, and are connected together by means of adhesive.

4. The indicator of claim 2, wherein said connective device on the enclosure is a longitudinally-shaped hole for passing through a cloth strip to engage the indicator with the golf club protector.

5. The indicator of claim 1, wherein said key reposition apparatus comprises a compressing spring and a slide-assisting member located at the end of the compressing spring near the driving wheel, the other end of the compressing spring is supported by the inner surface of the enclosure, and the slide-assisting member forms slide fit with the driving wheel.

6. The indicator of claim 5, wherein said enclosure comprises a front cover and a back cover, and the front cover and the back cover are connected together through engagement of a tenon with a tenon groove, and are connected together by means of adhesive.

7. The indicator of claim 5, wherein said connective device on the enclosure is a longitudinally-shaped hole for passing through a cloth strip to engage the indicator with the golf club protector.

8. The indicator of claim 1, wherein a key member is formed on the peripheral edge of each of said first half shaft and said second half shaft, and the key members are engaged with the key slots in the enclosure to fix the first half shaft and the second half shaft circumferentially.

9. The indicator of claim 8, wherein said enclosure comprises a front cover and a back cover, and the front cover and the back cover are connected together through engagement of a tenon with a tenon groove, and are connected together by means of adhesive.

10. The indicator of claim 8, wherein said connective device on the enclosure is a longitudinally-shaped hole for passing through a cloth strip to engage the indicator with the golf club protector.

11. The indicator of claim 1, wherein said enclosure comprises a front cover and a back cover, and the front cover and the back cover are connected together through engagement of a tenon with a tenon groove, and are connected together by means of adhesive.

12. The indicator of claim 1, wherein said connective device on the enclosure is a longitudinally-shaped hole for passing through a cloth strip to engage the indicator with the golf club protector.

* * * * *